US005282958A

United States Patent [19]

Santilli et al.

[11] Patent Number: 5,282,958

[45] Date of Patent: Feb. 1, 1994

[54] USE OF MODIFIED 5-7 A PORE MOLECULAR SIEVES FOR ISOMERIZATION OF HYDROCARBONS

[75] Inventors: Donald S. Santilli, Larkspur; Mohammad M. Habib; Thomas V. Harris, both of Benicia; Stacey I. Zones, San Francisco, all of Calif.

[73] Assignee: Chevron Research and Technology Company, San Francisco, Calif.

[21] Appl. No.: 556,560

[22] Filed: Jul. 20, 1990

[51] Int. Cl.[5] ..... C07C 5/13; C10G 11/02

[52] U.S. Cl. ..... 208/111; 208/27; 208/97; 585/737; 585/739

[58] Field of Search ..... 585/739, 740; 208/111, 208/27, 97

[56] References Cited

U.S. PATENT DOCUMENTS

| | | | |
|---|---|---|---|
| 4,148,713 | 4/1979 | Rollmann | 585/739 |
| 4,374,296 | 2/1983 | Haag et al. | 585/739 |
| 4,394,251 | 7/1983 | Miller | 585/739 |
| 4,414,097 | 11/1983 | Chester et al. | 208/111 |
| 4,421,634 | 12/1983 | Olavesen | 208/111 |
| 4,440,871 | 4/1984 | Lok et al. | 502/214 |
| 4,448,673 | 5/1984 | Shibaki | 585/739 |
| 4,448,675 | 5/1984 | Chu | 585/739 |
| 4,574,043 | 3/1986 | Chester | 208/27 |
| 4,689,138 | 8/1987 | Miller | 208/111 |
| 4,859,311 | 8/1989 | Miller | 585/740 |
| 4,859,312 | 8/1984 | Miller | 585/740 |
| 4,864,805 | 9/1989 | Lock et al. | 585/740 |
| 4,869,806 | 9/1989 | Degnan et al. | 208/111 |
| 4,877,581 | 10/1989 | Chen | 585/739 |
| 4,898,660 | 2/1990 | Wilson et al. | 585/740 |
| 4,917,876 | 4/1990 | Lok et al. | 423/306 |
| 4,919,788 | 4/1990 | Chen et al. | 585/739 |
| 4,939,977 | 6/1990 | Zones et al. | 585/739 |
| 4,943,424 | 7/1990 | Miller | 423/306 |
| 4,975,177 | 12/1990 | Garwood et al. | 208/111 |
| 5,007,997 | 4/1991 | Zones et al. | 585/739 |
| 5,019,661 | 5/1991 | Mole | 585/739 |
| 5,082,986 | 1/1992 | Miller | 585/667 |
| 5,135,638 | 8/1992 | Miller | 208/27 |
| 5,149,421 | 9/1992 | Miller | 208/27 |

*Primary Examiner*—Helane Myers

*Attorney, Agent, or Firm*—Fliesler, Dubb, Meyer & Lovejoy

[57] ABSTRACT

A process is disclosed for dewaxing a hydrocarbon feed to produce a dewaxed lube oil. The feed includes straight chain and slightly branched chain paraffins having 10 or more carbon atoms. In the process the feed is contacted under isomerization conditions with an intermediate pore size molecular sieve having a crystallite size of no more than about 0.5μ and pores with a minimum diameter of at least 4.8Å and with a maximum diameter of 7.1Å or less. The catalyst has sufficient acidity so that 0.5 g thereof when positioned in a tube reactor converts at least 50% of hexadecane at 370° C., a pressure of 1200 psig, a hydrogen flow of 160 ml/min, and a feed rate of 1 ml/hr. It also exhibits 40 or greater isomerization selectivity when used under conditions leading to 96% conversion of hexadecane to other chemicals. The catalyst includes at least one Group VIII metal. The contacting is carried out at a pressure from about 15 psig to about 3000 psig.

14 Claims, No Drawings

USE OF MODIFIED 5-7 A PORE MOLECULAR SIEVES FOR ISOMERIZATION OF HYDROCARBONS

TECHNICAL FIELD

The present invention is concerned with a process for converting a high pour point oil to a low pour point oil with a high viscosity index (VI) in high yield. The catalyst utilized is a crystalline molecular sieve having a pore size of no greater than about 7.1Å. The crystallite size of the molecular sieve is generally no more than about 0.5 microns.

BACKGROUND OF THE INVENTION

A large number of molecular sieves are known to have use as catalysts in various hydrocarbon conversion reactions such as one or more of reforming, catalytic cracking, isomerization and dewaxing. Typical intermediate pore size molecular sieves of this nature include ZSM-5, silicalite, generally considered to be a high silica to alumina ratio form of ZSM-5, ZSM-11, ZSM-22, ZSM-23, ZSM-35, SSZ-32, SAPO-11, SAPO-31, SAPO-41, and the like. Zeolites such as ZSM-5, ZSM-11, ZSM-12, ZSM-23, ZSM-35 and ZSM-38 have been proposed for use in dewaxing processes and are described in U.S. Pat. Nos. 3,700,585; 3,894,938; 3,849,290; 3,950,241; 4,032,431; 4,141,859 4,176,050; 4,181,598; 4,222,855; 4,229,282; and 4,247,388 and in British Pat. No. 1,469,345. Other zeolitic catalysts of slightly larger pore size, but still of, for example, 7.1Å or less, are also known to catalyze such reactions. L-zeolite and ZSM-12 are examples of such materials.

Attempts to utilize such catalysts as are discussed above for converting an oil which has a relatively high pour point to an oil which has a relatively low pour point have led to a significant portion of the original oil being hydrocracked to form relatively low molecular weight products which must be separated from the product oil thereby leading to a relatively low yield of the desired product.

High-quality lubricating oils are critical for the operation of modern machinery and automobiles. Unfortunately, the supply of natural crude oils having good lubricating properties is not adequate for present demands. Due to uncertainties in world crude oil supplies, high-quality lubricating oils must be produced from ordinary crude feedstocks and can even be produced from paraffinic synthetic polymers. Numerous processes have been proposed for producing lubricating oils that can be converted into other products by upgrading the ordinary and low-quality stocks.

It is desirable to upgrade a crude fraction otherwise unsuitable for lubricant manufacture into one from which good yields of lube oils can be obtained as well as being desirable to dewax more conventional lube oil stock in high yield. Indeed, it is even at times desirable to reduce waxes in relatively light petroleum fractions such as kerosene/jet fuels. Dewaxing is required when highly paraffinic oils are to be used in products which need to remain mobile at low temperatures, e.g., lubricating oils, heating oils and jet fuels. The higher molecular weight straight chain normal and slightly branched paraffins which are present in oils of this kind are waxes which cause high pour points and high cloud points in the oils. If adequately low pour points are to be obtained, these waxes must be wholly or partly removed. In the past, various solvent removal techniques were used such as propane dewaxing and MEK dewaxing but these techniques are costly and time consuming. Catalytic dewaxing processes are more economical and achieve this end by selectively cracking the longer chain n-paraffins to produce lower molecular weight products, some of which may be removed by distillation.

Because of their selectivity, prior art dewaxing catalysts generally comprise an aluminosilicate zeolite having a pore size which admits the straight chain n-paraffins either alone or with only slightly branched chain paraffins (sometimes referred to herein as waxes), but which excludes more highly branched materials, cycloaliphatics and aromatics. Zeolites such as ZSM-5, ZSM-11, ZSM-12, ZSM-23, ZSM-35 and ZSM-38 have been proposed for this purpose in dewaxing processes. Such processes are used to accomplish dewaxing on feeds which contain relatively low amounts of waxes, generally well below 50%, and they operate by selectively cracking the waxes. These processes are not readily adapted for treating high wax content feeds since, due to the large amount of cracking which occurs, such waxes would tend to be cracked to provide very low molecular weight products.

Since dewaxing processes of this kind function by means of cracking reactions, a number of useful products become degraded to lower molecular weight materials. For example, waxy paraffins may be cracked to butane, propane, ethane and methane as may the lighter n-paraffins which do not contribute to the waxy nature of the oil. Because these lighter products are generally of lower value than the higher molecular weight materials, it would be desirable to limit the degree of cracking which takes place during a catalytic dewaxing process.

Although U.S. Pat. Nos. 3,700,585; 3,894,938; 4,176,050; 4,181,598; 4,222,855; 4,222,282; 4,247,388 and 4,859,311 teach dewaxing of waxy feeds, the processes disclosed therein do not disclose a process for producing high yields of a lube oil having a very low pour point and high viscosity index from feeds containing anywhere from a low to a very high wax content, i.e., greater than 80% wax, such as slack wax, deoiled wax or synthetic liquid polymers such as low molecular weight polyethylene.

Since processes which remove wax by cracking will give a low yield with very waxy feeds, isomerization processes are preferred. U.S. Pat. No. 4,734,539 discloses a method for isomerizing a naphtha feed using an intermediate pore size zeolite catalyst, such as an H-offretite catalyst. U.S. Pat. No. 4,518,485 discloses a process for dewaxing a hydrocarbon feedstock containing paraffins by a hydrotreating and isomerization process. A method to improve the yield in such processes would be welcome.

U.S. Pat. No. 4,689,138 discloses an isomerization process for reducing the normal paraffin content of a hydrocarbon oil feedstock using a catalyst comprising an intermediate pore size silicoaluminophosphate molecular sieve containing a Group VIII metal component which is occluded in the crystals during growth. Again, a method which would improve the yield would be welcome.

Lube oils may also be prepared from feeds having a high wax content such as slack wax by an isomerization process. In prior art wax isomerization processes, however, either the yield is low and thus the process is uneconomical, or the feed is not completely dewaxed.

When the feed is not completely dewaxed it must be recycled to a dewaxing process, e.g., a solvent dewaxer, which limits the throughput and increases cost. U.S. Pat. No. 4,547,283 discloses converting wax to lube. However, the MEK dewaxing following isomerization disclosed therein severely limits pour reduction and thus, very low pour points cannot be achieved. Further, the catalyst disclosed therein is much less selective than the catalysts used in the present invention.

The present invention is directed to overcoming one or more of the problems as set forth above.

DISCLOSURE OF THE INVENTION

In accordance with an embodiment of the present invention a process is set forth for converting a relatively high pour point oil to a relatively low pour point oil with a high viscosity index. The process comprises contacting the relatively high pour point oil under isomerization conditions with a molecular sieve having pores of 7.1Å, most preferably ≦6.5Å, or less in diameter, having at least one pore diameter greater than or equal to 4.8Å and having a crystallite size of no more than about 0.5 micron. The catalyst is characterized in that it has sufficient acidity to convert at least 50% of hexadecane at 370° C. and exhibits a 40 or greater isomerization selectivity ratio as defined herein at 96% hexadecane conversion. The catalyst further includes at least one Group VIII metal and the process is carried out at a pressure from about 15 psig to about 3000 psig.

When operating in accordance with the present invention one can produce a low pour point, high viscosity index final product oil from a high pour point oil feed at high yield. Through maintaining the pore size at 7.1Å or less too much of the feed is not admitted to the pores thereby discouraging hydrocracking reactions. Basically, the pores should have no diameters greater than 7.1Å and should have at least one diameter greater than 5 Å (see, for example, Atlas of Zeolite Structure Types, W. M. Meier and D. H. Olson, Second Edition, 1987, Butterworths, London which is incorporated herein by reference for pore diameters of zeolites). The molecular sieves must be about 5Å in minimum pore dimension so that methyl branching can occur. The molecular sieves are basically optimized to allow the initially formed branched species to escape the pore system before cracking occurs. This is done by using the required small crystallite size molecular sieves and/or by modifying the number, location and acid strength of the acid sites present on the molecular sieve. The result of operating in accordance with the present invention is the production of a high viscosity index, low pour point product with high yield.

DETAILED DESCRIPTION OF THE INVENTION

In accordance with the method of the present invention a process is set forth for isomerizing hydrocarbons utilizing a crystalline molecular sieve wherein the molecular sieve is of the 10- or 12- member ring variety and has a maximum pore diameter of no more than 7.1Å across. Specific molecular sieves which are useful in the process of the present invention include the zeolites ZSM-12, ZSM-21, ZSM-22, ZSM-23, ZSM-35, ZSM-38, ZSM-48, ZSM-57, SSZ-32, ferrierite and L and other molecular sieve materials based upon aluminum phosphates such as SAPO-11, SAPO-31, SAPO-41, MAPO-11 and MAPO-31. Such molecular sieves are described in the following publications, each of which is incorporated herein by reference: U.S. Pat. Nos. 3,702,886; 3,709,979; 3,832,449; 3,950,496; 3,972,983; 4,076,842; 4,016,245; 4,046,859; 4,234,231; 4,440,871 and U.S. patent application Ser. Nos. 172,730 filed Mar. 23, 1988 and 433,382, filed Oct. 24, 1989.

The molecular sieves of the invention are optimized to allow the initially formed branched species to escape the pore systems of the catalysts before cracking occurs. This is done by using small crystallite size molecular sieves and/or by modifying the number, location and/or strength of the acid sites in the molecular sieves. The greater the number of acid sites of the molecular sieves, the smaller must be the crystallite size in order to provide optimum dewaxing by isomerization with minimized cracking. Those molecular sieves which have few and/or weak acid sites may have relatively large crystallite size, while those molecular sieves which have many and/or relatively strong acid sites must be smaller in crystallite size.

The length of the crystallite in the direction of the pores is the critical dimension. X-ray diffraction (XRD) can be used to measure the crystallite length by line broadening measurements. The preferred size crystallites in this invention are ≦0.5, more preferably ≦0.2, still more preferably ≦0.1 micron along the direction of the pores (the "c-axis") in many cases and XRD line broadening for XRD lines corresponding to the pore direction is observed for these preferred crystallites. For the smaller size crystallites, particularly those having a crystallite size of ≦0.2 micron, acidity becomes much less important since the branched molecules can more readily escape before being cracked. This is even more true when the crystallite size is ≦0.1 micron. For crystallites larger than 1 to 2 microns, scanning electron microscope (SEM) or transmission electron microscope (TEM) is needed to estimate the crystallite length because the XRD lines are not measurably broadened. In order to use SEM or TEM accurately, the molecular sieve catalyst must be composed of distinct individual crystallites, not agglomerates of smaller particles in order to accurately determine the size. Hence, SEM and TEM measured values of crystallite length are somewhat less reliable than XRD values.

The method used to determine crystallite size using XRD is described in Klug and Alexander "X-ray Diffraction Procedures", Wiley, 1954 which is incorporated herein by reference. Thus, $$D=(K\cdot\lambda)/(\beta\cdot\cos\theta),$$

where:

D = crystallite size, Å
K = constant ≈ 1
λ = wavelength, Å
β = corrected half width in radians
θ = diffraction angle For crystallites ≧ about 0.1 micron in length, (along the pore direction) decreasing the number of acid sites (by exchange of $H^+$ by with an alkali or alkaline earth cation for example) can increase the isomerization selectivity to a certain extent. The isomerization selectivity of smaller crystallites is less dependent on the acidity since the branched products can more readily escape before being cracked. Titration during the isomerization process (by adding a base such as $NH_3$) to decrease acidity during a run can also increase isomerization selectivity to a small extent.

The most preferred catalysts of the invention are of the 10-membered ring variety (10 oxygen atoms in the ring defining the pore opening) with the molecular sieves having pore opening sizes of ≦7.1 Å, preferably ≦6.5Å. Such catalysts include ZSM-21, ZSM-22, ZSM-23, ZSM-35, ZSM-38, ZSM-48, ZSM-57, SSZ-32, ferrierite, SAPO-11 and MAPO-11. Other useful molecular sieves include SAPO-31, SAPO-41, MAPO-31 and SSZ-25, the precise structures of which are not known but whose adsorption characteristics and catalytic properties are such that they satisfy the pore size requirements of the catalysts useful in the process of the present invention. Also useful as catalysts are 12-membered ring zeolitic molecular sieves such as L zeolite and ZSM-12, having deformed (non-circular) pores which satisfy the requirement that they have no cross-dimension greater than 7.1Å.

The present invention makes use of catalysts with selected acidity, selected pore diameter and selected crystallite size (corresponding to selected pore length). The selection is such as to insure that there is sufficient acidity to catalyze isomerization and such that the product can escape the pore system quickly enough so that cracking is minimized. The pore diameter requirements have been set forth above. The required relationship between acidity and crystallite size of the molecular sieves in order to provide an optimum high viscosity index oil with high yield is defined by carrying out standard isomerization selectivity tests for isomerizing n-hexadecane. The test conditions include a pressure of 1200 psig, hydrogen flow of 160 ml/min (at 1 atmosphere pressure and 25° C.), a feed rate of 1 ml/hr and the use of 0.5 g of catalyst loaded in the center of a 3 feet long by 3/16 inch inner diameter stainless steel reactor tube (the catalyst is located centrally of the tube and extends about 1 to 2 inches in length) with alundum loaded upstream of the catalyst for preheating the feed. A catalyst, if it is to qualify as a catalyst of the invention, when tested in this manner, must convert at least 50% of the hexadecane at a temperature of 370° C. or below and will preferably convert 96% or more of the hexadecane at a temperature below 355° C. Also, when the catalyst is run under conditions which lead to 96% conversion of hexadecane the isomerization selectivity obtained by raising the temperature, by which is meant the selectivity for producing isomerized hexadecane as opposed to cracked products must be 40 or greater, more preferably 50 or greater. The isomerization selectivity, which is a ratio, is defined as:

$$\frac{\text{wt \% branched } C_{16} \text{ in product}}{\text{wt \% branched } C_{16} \text{ in product} + \text{wt \% } C_{13}\text{— in product}} \times 100 \text{ at 96\% } nC_{16} \text{ conversion.}$$

This assures that the number of acid sites is sufficient to provide needed isomerization activity but is low enough so that cracking is minimized. Too few sites leads to insufficient catalyst activity. With too many sites with larger crystallites, cracking predominates over isomerization.

Increasing the crystallite size of a given catalyst (having a fixed $SiO_2/Al_2O_3$ ratio) increases the number of acid, e.g., aluminum, sites in each pore. Above a certain crystallite size range, cracking, rather than isomerization, dominates.

The molecular sieve crystallites can suitably be bound with a matrix or porous matrix. The terms "matrix" and "porous matrix" include inorganic compositions with which the crystallites can be combined, dispersed, or otherwise intimately admixed. Preferably, the matrix is not catalytically active in a hydrocarbon cracking sense, i.e., is substantially free of acid sites. The matrix porosity can either be inherent or it can be caused by a mechanical or chemical means. Satisfactory matrices include diatomaceous earth and inorganic oxides. Preferred inorganic oxides include alumina, silica, naturally occurring and conventionally processed clays, for example bentonite, kaolin, sepiolite, attapulgite and halloysite.

Compositing the crystallites with an inorganic oxide matrix can be achieved by any suitable known method wherein the crystallites are intimately admixed with the oxide while the latter is in a hydrous state (for example, as a hydrous salt, hydrogel, wet gelatinous precipitate, or in a dried state, or combinations thereof). A convenient method is to prepare a hydrous mono or plural oxide gel or cogel using an aqueous solution of a salt or mixture of salts (for example aluminum and sodium silicate). Ammonium hydroxide carbonate (or a similar base) is added to the solution in an amount sufficient to precipitate the oxides in hydrous form. Then, the precipitate is washed to remove most of any water soluble salts and it is thoroughly admixed with the crystallites. Water or a lubricating agent can be added in an amount sufficient to facilitate shaping of the mix (as by extrusion).

The feedstocks which can be treated in accordance with the present invention include oils which generally have relatively high pour points which it is desired to reduce to relatively low pour points.

The present process may be used to dewax a variety of feedstocks ranging from relatively light distillate fractions such as kerosene and jet fuel up to high boiling stocks such as whole crude petroleum, reduced crudes, vacuum tower residua, cycle oils, synthetic crudes (e.g., shale oils, tars and oil, etc.), gas oils, vacuum gas oils, foots oils, and other heavy oils. Straight chain n-paraffins either alone or with only slightly branched chain paraffins having 16 or more carbon atoms are sometimes referred to herein as waxes. The feedstock will often be a $C_{10+}$ feedstock generally boiling above about 350° F. since lighter oils will usually be free of significant quantities of waxy components. However, the process is particularly useful with waxy distillate stocks such as middle distillate stocks including gas oils, kerosenes, and jet fuels, lubricating oil stocks, heating oils and other distillate fractions whose pour point and viscosity need to be maintained within certain specification limits. Lubricating oil stocks will generally boil above 230° C. (450° F.), more usually above 315° C. (600° F.). Hydroprocessed stocks are a convenient source of stocks of this kind and also of other distillate fractions since they normally contain significant amounts of waxy n-paraffins. The feedstock of the present process will normally be a $C_{10+}$ feedstock containing paraffins, olefins, naphthenes, aromatic and heterocyclic compounds and with a substantial proportion of higher molecular weight n-paraffins and slightly branched paraffins which contribute to the waxy nature of the feedstock. During the processing, the n-paraffins and the slightly branched paraffins undergo some cracking or hydrocracking to form liquid range materials which contribute to a low viscosity product. The degree of cracking which occurs is, however, limited so that the yield of products having boiling points below that of the feedstock is reduced, thereby preserving the economic value of the feedstock.

Typical feedstocks include light gas oils, heavy gas oils and reduced crudes boiling above 350° F. Typical feeds might have the following general composition:

| | |
|---|---|
| API Gravity | 25-50 |
| Nitrogen | 0.2-150 ppm |
| Waxes | 1-100 (pref. 5-100)% |
| VI | 70-170* |
| Pour Point | ≧0° C. (often ≧20° C.) |
| Boiling Point Range | 315-700° C. |
| Viscosity, (cSt @ 40° C.) | 3-1000 |

*This is the VI after solvent dewaxing

A typical product might have the following composition:

| | |
|---|---|
| API Gravity | 20-40 |
| VI | 90-160 |
| Pour Point | <0° C. |
| Boiling Point Range | 315-700° C. |
| Viscosity, (cSt @ 40° C.) | 3-1000 |

The typical feedstocks which are advantageously treated in accordance with the present invention will generally have an initial pour point above about 0° C., more usually above about 20° C. The resultant products after the process is completed generally have pour points which fall below −0° C., more preferably below about −10° C.

As used herein, the term "waxy feed" includes petroleum waxes. The feedstock employed in the process of the invention can be a waxy feed which contains greater than about 50% wax, even greater than about 90% wax. Highly paraffinic feeds having high pour points, generally above about 0° C., more usually above about 10° C. are also suitable for use in the process of the invention. Such a feeds can contain greater than about 70% paraffinic carbon, even greater than about 90% paraffinic carbon.

Exemplary additional suitable feeds for use in the process of the invention include waxy distillate stocks such as gas oils, lubricating oil stocks, synthetic oils such as those by Fischer-Tropsch synthesis, high pour point polyalphaolefins, foots oils, synthetic waxes such as normal alphaolefin waxes, slack waxes, deoiled waxes and microcrystalline waxes. Foots oil is prepared by separating oil from the wax. The isolated oil is referred to as foots oil.

The feedstock may be a $C_{20+}$ feedstock generally boiling above about 600° F. The process of the invention is useful with waxy distillate stocks such as gas oils, lubricating oil stocks, heating oils and other distillate fractions whose pour point and viscosity need to be maintained within certain specification limits. Lubricating oil stocks will generally boil above 230° C. (450° F.), more usually above 315° C. (600° F.). Hydroprocessed stocks are a convenient source of stocks of this kind and also of other distillate fractions since they normally contain significant amounts of waxy n-paraffins. The feedstock of the present process may be a $C_{20+}$ feedstock containing paraffins, olefins, naphthenes, aromatics and heterocyclic compounds and a substantial proportion of higher molecular weight n-paraffins and slightly branched paraffins which contribute to the waxy nature of the feedstock. During processing, the n-paraffins and the slightly branched paraffins undergo some cracking or hydrocracking to form liquid range materials which contribute to a low viscosity product. The degree of cracking which occurs is, however, limited so that the yield of low boiling products is reduced, thereby preserving the economic value of the feedstock.

Slack wax can be obtained from either a hydrocracked lube oil or a solvent refined lube oil. Hydrocracking is preferred because that process can also reduce the nitrogen content to low values. With slack wax derived from solvent refined oils, deoiling can be used to reduce the nitrogen content. Optionally, hydrotreating of the slack wax can be carried out to lower the nitrogen content thereof. Slack waxes possess a very high viscosity index, normally in the range of from 140 to 200, depending on the oil content and the starting material from which the wax has been prepared. Slack waxes are therefore eminently suitable for the preparation of lubricating oils having very high viscosity indices, i.e., from about 120 to about 180.

Feeds also suitable for use in the process of the invention are partially dewaxed oils wherein dewaxing to an intermediate pour point has been carried out by a process other than that claimed herein, for example, conventional catalytic dewaxing processes and solvent dewaxing processes. Exemplary suitable solvent dewaxing processes are set forth in U.S. Pat. No. 4,547,287.

The process of the invention may also be employed in combination with conventional dewaxing processes to achieve a lube oil having particular desired properties. For example, the process of the invention can be used to reduce the pour point of a lube oil to a desired degree. Further reduction of the pour point can then be achieved using a conventional dewaxing process. Under such circumstances, immediately following the isomerization process of the invention, the lube oil may have a pour point greater than about 15° F. Further, the pour point of the lube oil produced by the process of the invention can be reduced by adding pour point depressant compositions thereto.

The conditions under which the isomerization/dewaxing process of the present invention is carried out generally include a temperature which falls within a range from about 200° C. to about 400° C. and a pressure from about 15 to about 3000 psig. More preferably the pressure is from about 100 to about 2500 psig. The liquid hourly space velocity during contacting is generally from about 0.1 to about 20, more preferably from about 0.1 to about 5. The contacting is preferably carried out in the presence of hydrogen. The hydrogen to hydrocarbon ratio preferably falls within a range from about 1.0 to about 50 moles $H_2$ per mole hydrocarbon, more preferably from about 10 to about 30 moles $H_2$ per mole hydrocarbon.

The product of the present invention may be further treated as by hydrofinishing. The hydrofinishing can be conventionally carried out in the presence of a metallic hydrogenation catalyst, for example, platinum on alumina. The hydrofinishing can be carried out at a temperature of from about 190° C. to about 340° C. and a pressure of from about 400 psig to about 3000 psig. Hydrofinishing in this manner is described in, for example, U.S. Pat. 3,852,207 which is incorporated herein by reference.

The feed preferably has an organic nitrogen content of less than about 100 ppmw.

To achieve the desired isomerization selectivity the catalyst includes a hydrogenation component which serves to promote isomerization, namely a Group VIII metal. Any of the known hydrogenation components may be utilized. Platinum and palladium are preferred.

The invention will be better understood by reference to the following illustrative examples.

EXAMPLE 1

The experimental isomerization selectivity of a catalyst can be measured by using a test with n-hexadecane feed at the conditions given in Table 1. The isomerization selectivity is defined as:

$$\frac{\text{wt \% branched } C_{16} \text{ in product}}{\text{wt \% branched } C_{16} \text{ in product} + \text{wt \% } C_{13}\text{— in product}} \times 100 \text{ at 96\% } nC_{16} \text{ conversion.}$$

The metals (0.5 wt %) were added by ion exchange using an aqueous solution of $Pd(NH_3)_4(NO_3)_2$ or $Pt(NH_3)_4(NO_3)_2$ buffered at a pH between 9 and 10 using dilute $NH_4OH$. The Na was added by ion exchange using a dilute aqueous solution of a sodium salt before the metal was exchanged.

It can be seen from Table 1 that 1.5 micron crystallites (having 1.5 microns pore length) have very low isomerization selectivity (10%) while ≦0.1 micron crystallites have >40% isomerization selectivity. Also, sodium exchange significantly increases the isomerization selectivity of a 0.09 micron crystallite catalyst, but led to little increase in isomerization selectivity of catalysts made with smaller crystallites. Titration (during prooessing) with ammonia also increased isomerization selectivity of catalysts to a small extent.

TABLE I

Measurement of isomerization selectivities of various catalysts using n-hexadecane feed. Pressure = 1200 psig, $H_2$ flow = 160 ml/min at 1 atm/25° C., feed rate = 1 ml/hr, catalyst wt = 0.5 g. Isomerization selectivity = 100 [$iC_{16}/iC_{16} + C_{13}$—] at 96% $C_{16}$ conversion. Temperature given is temperature required to reach 96% conversion.

| Catalyst | Pore length in microns by XRD. Crystalline size in the direction of the pores | Temp °F. | Isomerization Selectivity |
|---|---|---|---|
| Pt, $H^+K^+$, L | 1.5 | 640 | 10 |
| Pt, $H^+$, $K^+$, L | .06 | 620 | 53 |
| Pt, $H^+$, SSZ-32 | .041 | 597 | 64 |
| Pt, $H^+$, ZSM-23 | .033 | 560 | 71 |
| Pd, $H^+$, ZSM-22 | .087 | 578 | 42 |
| Pd, $H^+$, $Na^+$, ZSM-22 | .087 | 635 | 60 |
| Pd, $H^+$, ZSM-22 (titrated) | .087 | 635 | 47 |
| Pd, $H^+$, ZSM-23 | .054 | 540 | 55 |
| Pd, $H^+$, ZSM-23 | .033 | 544 | 63 |

TABLE I-continued

Measurement of isomerization selectivities of various catalysts using n-hexadecane feed. Pressure = 1200 psig, $H_2$ flow = 160 ml/min at 1 atm/25° C., feed rate = 1 ml/hr, catalyst wt = 0.5 g. Isomerization selectivity = 100 [$iC_{16}/iC_{16} + C_{13}$—] at 96% $C_{16}$ conversion. Temperature given is temperature required to reach 96% conversion.

| Catalyst | Pore length in microns by XRD. Crystalline size in the direction of the pores | Temp °F. | Isomerization Selectivity |
|---|---|---|---|
| Pd, $H^+$, $Na^+$, ZSM-23 | .033 | 565 | 65 |

EXAMPLE 2

Catalysts made with zeolites with similar pore openings but varying crystallite size were used to dewax a lube feed having a gravity of 31.3 API, 2.89 ppm sulfur, 0.72 ppm nitrogen, a pour point of 35° C., a viscosity at 40° C. of 33.7 cSt, at 70° C. of 12.1 cSt and at 100° C. of 5.911 cSt, a VI of 120 (−6° C. solvent dewaxed VI=104), an average molecular weight of 407, a boiling range of 343° C.–538° C. and a wax content of 10.4 wt %. Results are given in Table 2. It can be seen that catalysts with high isomerization selectivities produce a higher yield of lube product with a higher VI.

TABLE 2

Results for dewaxing a typical industrial feed stock for lube production. Conditions: WHSV = 1.24, Gas rate = 4900 SCF H2/BBL; Pressure 2300 psig. Yields and VI's for lube with −12° C. pour unless otherwise indicated.

| Catalyst | Pore Length microns | $nC_{16}$ isom sel | Lube Yield (−12° C. pour) | Temperature °F. | VI |
|---|---|---|---|---|---|
| $H^+$, SSZ-32 (no metal) | .041 | 1 | 82* | 610 | 101 |
| Pt, $H^+$, SSZ-32 | .041 | 64 | 87.5 | 575 | 107 |
| Pt, $H^+$, ZSM-22 | .089 | 42 | 83 | 570 | 102 |
| Pt, $H^+$, $Na^+$, ZSM-22 | .089 | 50 | 85 | 640 | 104 |
| Pt, $H^+$, ZSM-23 | .033 | 71 | 85.5 | 640 | 107 |

*Product @ −9° C. pour point

The acidity of the catalyst of the present invention can be controlled by conventionally reducing the alumina content of the catalysts. Ion exchange with alkali or alkaline earth cations can also be used to lower the acidity. Generally, the catalyst is contacted with a dilute aqueous solution of a (usually) sodium salt such as sodium nitrate and then dried before use or further processing.

The production of small crystallite molecular sieves can be accomplished by assuring a high nucleation rate preceding crystallization. This can be accomplished in several ways including the following:

1) The alkalinity of the reaction mixture used in the synthesis of the molecular sieve can be increased as described in Hydrothermal Chemistry Of Zeolites by R. M. Barrer (Academic Press, 1982) at pages 154–157, which are incorporated herein by reference;

2) Small amounts of dye molecules or of inorganic cations can be present during crystallization. These serve to retard crystal growth on certain faces of the growing crystal as described in British Pat. No. 1,453,115 which is incorporated herein by reference;

3) Nucleation can be accelerated using novel sources of inorganic reactants such as other zeolites as described in copending U.S. patent application Ser. No. 337,357 which is incorporated herein by reference;

4) Crystallization can be carried out at reduced temperature if the activation energy is relatively low as described in U.S. Pat. No. 4,073,865 which is incorporated herein by reference; or 5) High speed mixing can be carried out during crystallization to promote nucleation and disrupt crystal growth as described by R. W Thompson and A. Dyer, Zeolites, 5, 303 (1985) which is incorporated herein by reference.

Industrial Applicability

The present invention provides a process for isomerization, more particularly a process for the dewaxing, of waxy oils with the resulting product being produced in a relatively optimum amount and having a desirably high viscosity index.

While the invention has been described in connection with specific embodiments thereof, it will be understood that it is capable of further modification, and this application is intended to cover any variations, uses, or adaptations of the invention following, in general, the principles of the invention and including such departures from the present disclosure as come within known or customary practice in the art to which the invention pertains and as may be applied to the essential features hereinbefore set forth, and as fall within the scope of the invention and the limits of the appended claims.

I claim:

1. A process for dewaxing a hydrocarbon feed to produce a dewaxed lube oil, the feed including straight chain and slightly branched chain paraffins having 10 or more carbon atoms, comprising:

contacting the feed under isomerization conditions with an intermediate pore size molecular sieve having a crystallite size of no more than about 0.5μ, having pores with a minimum pore diameter of at least 4.8Å and with a maximum pore diameter of no more than 7.1Å, the catalyst 1) having sufficient acidity so that 0.5 g thereof when positioned in a ¼ inch internal diameter tube reactor converts at least 50% of hexadecane at a temperature of 370° C., a pressure of 1200 psig, a hydrogen flow of 160 ml/min and a feed rate of 1 ml/hr and 2) exhibiting 40 or greater isomerization selectivity which is defined as:

$$\frac{\text{wt \% branched } C_{16} \text{ in product}}{\text{wt \% branched } C_{16} \text{ in product} + \text{wt \% } C_{13-} \text{ in product}} \times 100,$$

when used under conditions leading to 96% conversion of hexadecane, the catalyst including at least one Group VIII metal, the contacting being carried out at a pressure from about 15 psig to about 3000 psig.

2. The process of claim 1, wherein said feed is selected from the group consisting of gas oils, lubricating oil stocks, synthetic oils, foots oils, Fischer-Tropsch synthesis oils, high pour point polyalphaolefins, normal alphaolefin waxes, slack waxes, deoiled waxes and microcrystalline waxes.

3. The process of claim 1, wherein said molecular sieve is selected from the group consisting of ZSM-12, ZSM-21, ZSM-22, ZSM-23, ZSM-35, ZSM-38, ZSM-48, ZSM-57, SSZ-32, ferrierite, SAPO-11, SAPO-31, SAPO-41, MAPO-11, MAPO-31 and L zeolite and said metal is selected from the group consisting of at least one of platinum and palladium.

4. The process of claim 1, wherein said contacting is carried out at a temperature of from about 200° C. to about 400° C. and a pressure of from about 15 psig to about 3000 psig.

5. The process of claim 4, wherein said pressure is from about 100 psig to about 2500 psig.

6. The process of claim 1, wherein the liquid hourly space velocity during contacting is from about 0.1 to about 20.

7. The process of claim 6, wherein the liquid hourly space velocity is from about 0.1 to about 5.

8. The process of claim 1, wherein contacting is carried out in the presence of hydrogen.

9. The process of claim 1, further comprising hydrofinishing the dewaxed lube oil.

10. The process of claim 9, wherein hydrofinishing is carried out at a temperature of from about 190° C. to about 340° C. and a pressure of from about 400 psig to about 3000 psig.

11. The process of claim 10, wherein hydrofinishing is carried out in the presence of a metallic hydrogenation catalyst.

12. The process of claim 1, wherein said feed has an organic nitrogen content of less than about 100 ppmw.

13. A process as set forth in claim 1, wherein the molecular sieve has a crystallite length in the direction of the pores which is ≦0.2 micron.

14. A process as set forth in claim 13, wherein the crystallite length in the direction of the pores is ≦0.1 microns.

* * * * *

UNITED STATES PATENT AND TRADEMARK OFFICE

CERTIFICATE OF CORRECTION

PATENT NO. : 5,282,958
DATED : February 1, 1994
INVENTOR(S) : Donald S. Santilli et al.

It is certified that error appears in the above-identified patent and that said Letters Patent is hereby corrected as shown below:

Title page,
Item [57], ABSTRACT,
Lines 11 and 15, change “hexadecane” to -- n-hexadecane --.

Column 3,
Lines 25 and 26, change “hexadecane” to -- n-hexadecane --.

Column 5,
Lines 39-41, change “hexadecane” to -- n-hexadecane --.

Column 11,
Line 48, change “hexadecane” to -- n-hexadecane --.

Column 12,
Line 6, change “hexadecane” to -- n-hexadecane --.

Signed and Sealed this

Fourth Day of February, 2003

JAMES E. ROGAN
*Director of the United States Patent and Trademark Office*